United States Patent [19]

Doyle

[11] Patent Number: 4,693,035

[45] Date of Patent: Sep. 15, 1987

[54] MULTIPLE OPTICAL FIBER POLISHING APPARATUS

[75] Inventor: Ralph R. Doyle, Arlington Heights, Ill.

[73] Assignee: Buehler Ltd., Lake Bluff, Ill.

[21] Appl. No.: 792,785

[22] Filed: Oct. 30, 1985

[51] Int. Cl.[4] ..... B24B 7/22

[52] U.S. Cl. ..... 51/125; 51/277; 51/284 R

[58] Field of Search ..... 51/125, 217 R, 217 L, 51/23 TT, 277 R, 284 R, 283 R

[56] References Cited

U.S. PATENT DOCUMENTS

| | | | |
|---|---|---|---|
| 3,587,196 | 6/1971 | Dunn | 51/283 |
| 3,868,794 | 3/1975 | Zitkus | 51/283 |
| 4,384,431 | 5/1983 | Jackson | 51/283 R |
| 4,492,060 | 1/1985 | Clark | 51/283 R |
| 4,498,260 | 2/1985 | Doty | 51/217 R |
| 4,539,776 | 9/1985 | Weaver, Jr. | 51/217 R |

FOREIGN PATENT DOCUMENTS

| | | | |
|---|---|---|---|
| 0161256 | 9/1984 | Japan | 51/283 R |

*Primary Examiner*—Frederick R. Schmidt
*Assistant Examiner*—Robert A. Rose
*Attorney, Agent, or Firm*—Charles F. Pigott, Jr.

[57] ABSTRACT

Apparatus for polishing the ends of multiple fiber optic members to a precise predetermined length. The invention relates in particular to appartus for gripping and holding a plurality of fiber optic connectors, each of which has a fiber optic cable connected thereto with a small fiber optic end projecting. The apparatus serves to accurately hold and position a large number of such fiber optic connectors and advance them under controlled conditions of speed and force into engagement with a polishing member such as a rotatable platen having an abrasive surface.

17 Claims, 20 Drawing Figures

FIG. 6A
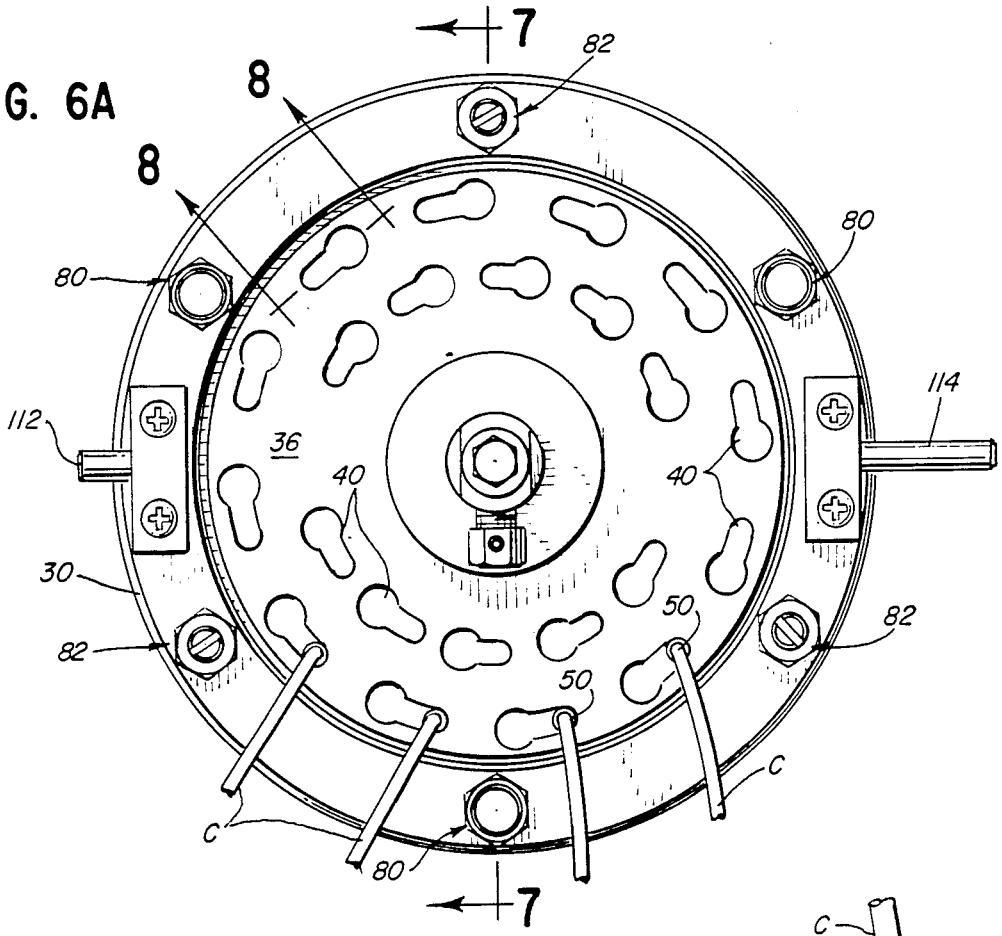
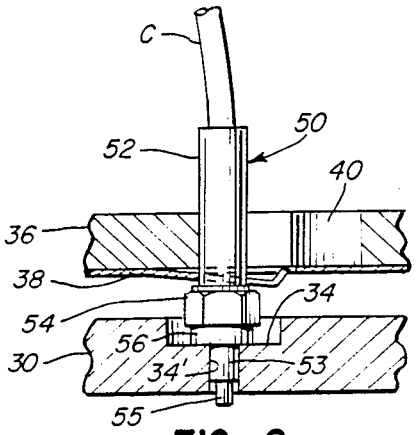
FIG. 8
FIG. 6B
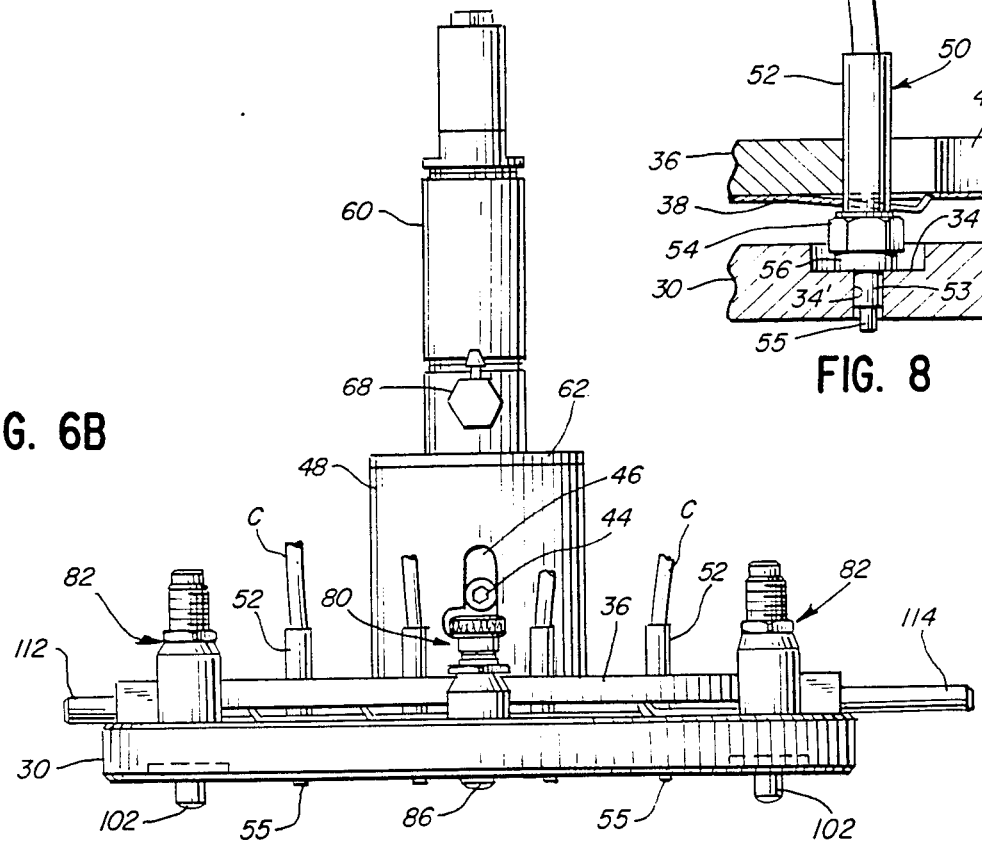

MULTIPLE OPTICAL FIBER POLISHING APPARATUS

BRIEF SUMMARY OF THE INVENTION

It is known to provide apparatus for polishing the end of a fiber optic. In such a case a fiber optic cable is connected near its end to a fiber optic connector so that a portion of the cable projects with a tiny fiber optic member projecting from the end of the cable. Before such a fiber optic cable can be joined to the end of a like cable to create a continuous fiber optic cable, it is necessary that the end of the fiber optic be polished to a predetermined length. It is often necessary to polish such a fiber optic to a precise length, i.e., so the fiber optic projects a predetermined amount from a reference point such as a shoulder on the fiber optic connector within a tolerance of only 0.0003 inch.

It is also known to provide both an initial or rough polishing followed by a final polishing operation. During the final polishing, an additional amount of material is removed from the end of a fiber optic, such as 0.002 inch of material beyond what was removed during rough polishing. A different polishing medium or abrasive material is used for the finish polishing as compared to the initial or rough polishing operation. Apparatus for polishing the end of a single fiber optic is disclosed in my copending application, Doyle U.S. Ser. No. 604,898, entitled "Apparatus and Method for Polishing the Ends of Fiber Optics", which is assigned to the assignee of the present invention.

It is a general object of the present invention to provide apparatus for simultaneously polishing the ends of a plurality of fiber optics while still achieving great accuracy with respect to the final length of each fiber optic.

A more specific object of my invention is to provide apparatus for holding and gripping a large number of fiber optic connectors and advancing them under controlled conditions of speed and force to engage a plurality of fiber optic ends into engagement with a polishing member such as a rotatable platen having an abrasive surface.

Another object is to provide improved adjustable stop means to control the amount of material removed from the ends of a plurality of fiber optic members during rough polishing and the additional amount of material removed during final polishing.

Another of my objects is to provide improved shock absorber means associated with a connector holder plate including means which permits the connector holder plate to "float" during an initial portion of a polishing operation after which added force is applied to complete the polishing of a plurality of fiber optics to a predetermined length within close tolerances.

The foregoing and other objects and advantages of my invention will be apparent from the following description of a preferred embodiment, taken in conjunction with the accompanying drawings.

DESCRIPTION OF THE DRAWINGS

FIG. 6*a* is a top plan view similar to FIG. 3*a* showing the lock plate member rotated to its clockwise locked position where the smaller portions of the keyhole openings are aligned with the connector members to retain them in position;

FIG. 6*b* is a vertical elevation corresponding to FIG. 6*a* and showing the lock plate member in its lower locked position;

FIG. 8 is a fragmentary vertical section taken along the line 8—8 of FIG. 6;

Now, in order to acquaint those skilled in the art with the manner of making and using my invention, I shall describe, in conjunction with the accompanying drawings, a preferred embodiment of my invention.

DETAILED DESCRIPTION OF THE INVENTION

Figure 1A:
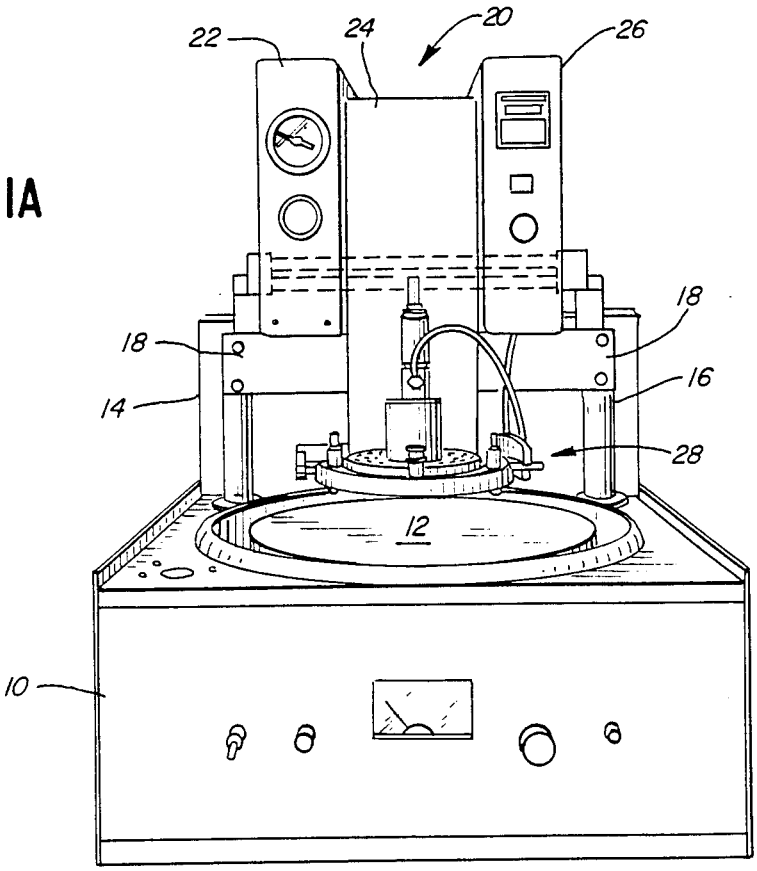
FIG. 1*a* is a perspective view of a polishing machine constructed in accordance with the present invention.

Referring now to the drawings, FIG. 1*a* shows a complete apparatus for simultaneously polishing the ends of multiple fiber optic members in a single operation. The apparatus comprises a base 10, a rotatable platen 12 having an abrasive surface, a stationary frame including upright members 14 and 16 and horizontal member 18, and an upper head structure shown generally at 20. The upper head structure head 20 includes members 22, 24 and 26 which slide horizontally from left to right and back on a fixed horizontal track associated with the horizontal frame member 18. In addition, head 20 is movable vertically at the same time it is moving horizontally.

The upper head 20 includes drive and control apparatus (not shown) for oscillating head 20 horizontally between left and right positions and for moving head 20 up and down. As a result, head 20 is movable horizontally between left hand and right hand positions and is movable vertically between upper and lower positions to carry out a polishing operation.

Figure 1B:
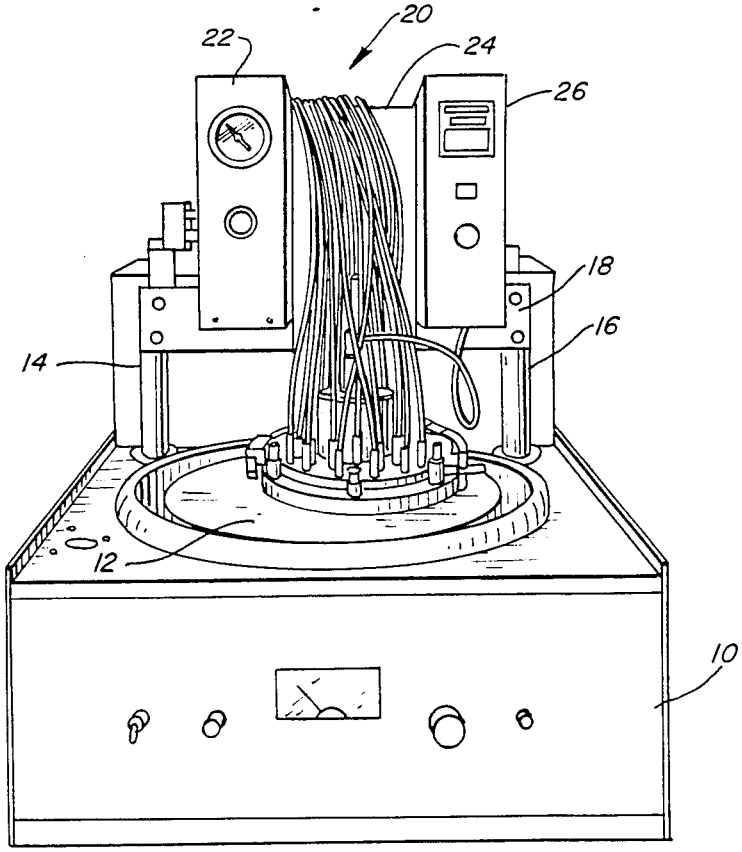
FIG. 1*b* is a perspective view similar to FIG. 1*a* showing the machine loaded with a large number of fiber optic connectors secured at the ends of corresponding fiber optic cables and held in a holding fixture which advances the fiber optic ends of the cables into engagement with a rotating abrasive platen for polishing the ends of the fiber optic members to a precise predetermined length.

FIG. 1*a* further shows a connector holder assembly 28 constructed in accordance with the present invention. The purpose of the connector holder assembly 28 is to hold a plurality of fiber optic connectors, each of which is attached to the end of a fiber optic cable having a small projecting fiber optic end to be polished to a predetermined length. FIG. 1*b* is similar to FIG. 1*a* and shows a plurality of fiber optic connectors mounted in the connector holder assembly 28 and held therein for purposes of conducting a polishing operation. The plurality of fiber optic cables are shown draped over the top of the center head member 24.

Figure 10:
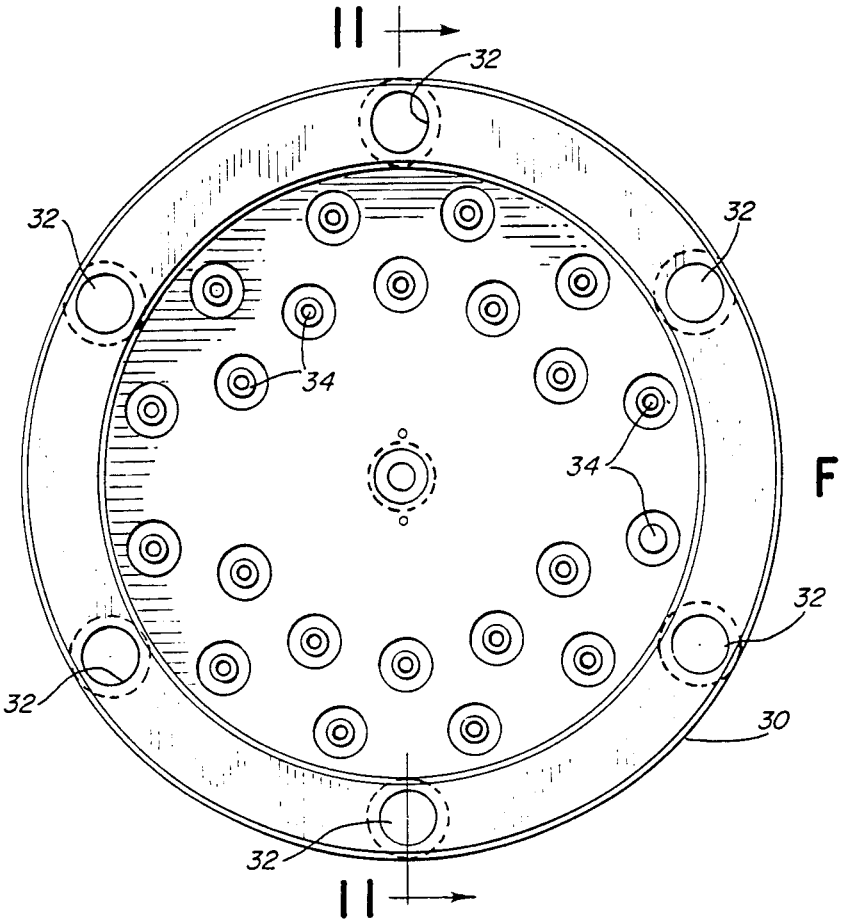
FIG. 10 is a detail top plan view of a connector holder plate.
Figure 11:
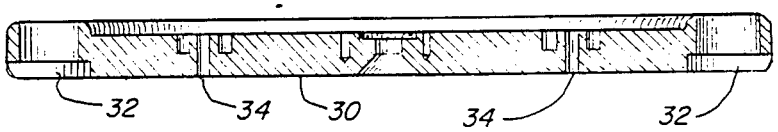
FIG. 11 is a side elevational view of the connector holder plate of FIG. 10.

The connector holder assembly 28 will now be described in detail. The assembly 28 includes a connector holder plate 30 shown in detail in FIGS. 10 and 11. The connector holder plate 30 is a precision machined circular metal plate having six openings 32 equally spaced around its periphery. As will be described more fully later herein, three of the openings 32 are to mount adjustable diamond stop members, and the other three openings are to mount three shock absorber members. The connector holder plate 330 is provided with 22 additional countersunk openings 34 to receive and hold fiber optic connectors during a polishing operation. While the apparatus described herein is designed to polish 22 fiber optic ends in a single operation, the invention may be utilized to polish a greater or lesser number of fiber optic ends as desired.

Figure 3A:
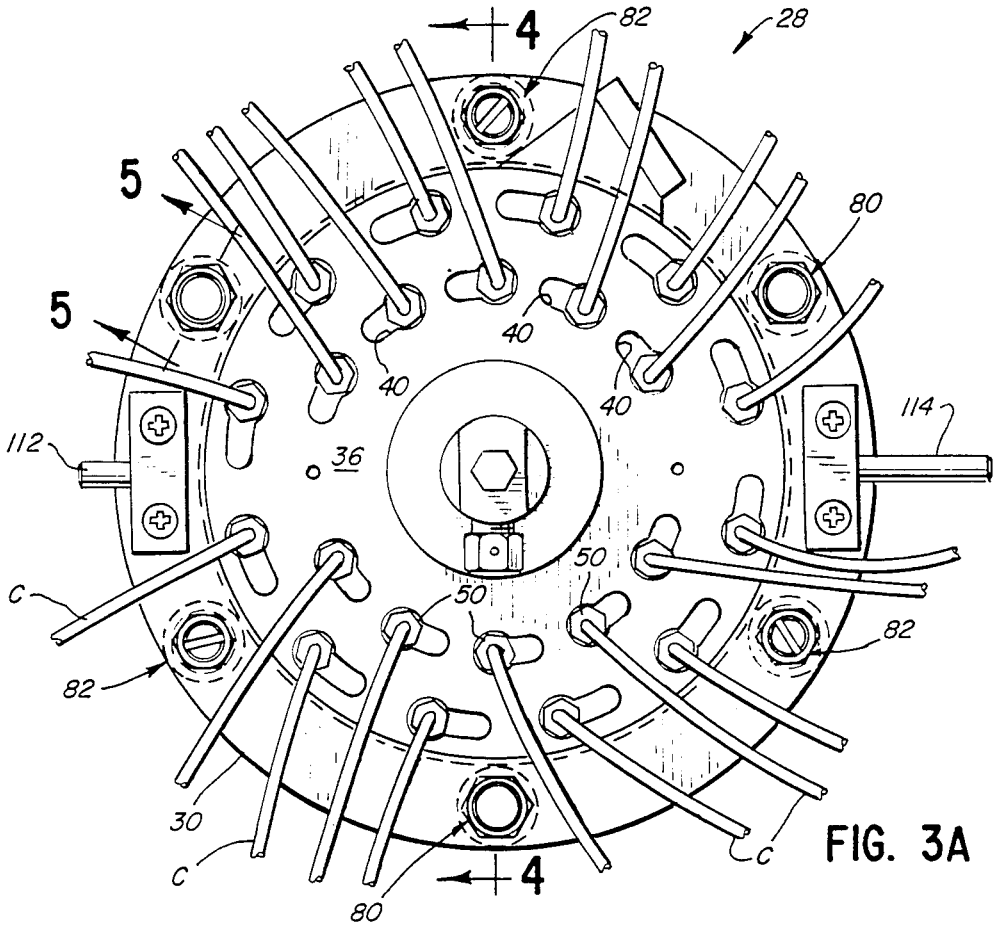
FIG. 3*a* is an enlarged detail top plan view of a connector holder assembly constructed in accordance with the present invention, there being shown a plurality of fiber optic connectors, each one attached to the end of a corCresponding fiber optic cable, the connectors being manually inserted down through keyhole openings in a rotatable lock plate which is shown in its counterclockwise release position.
Figure 3B:
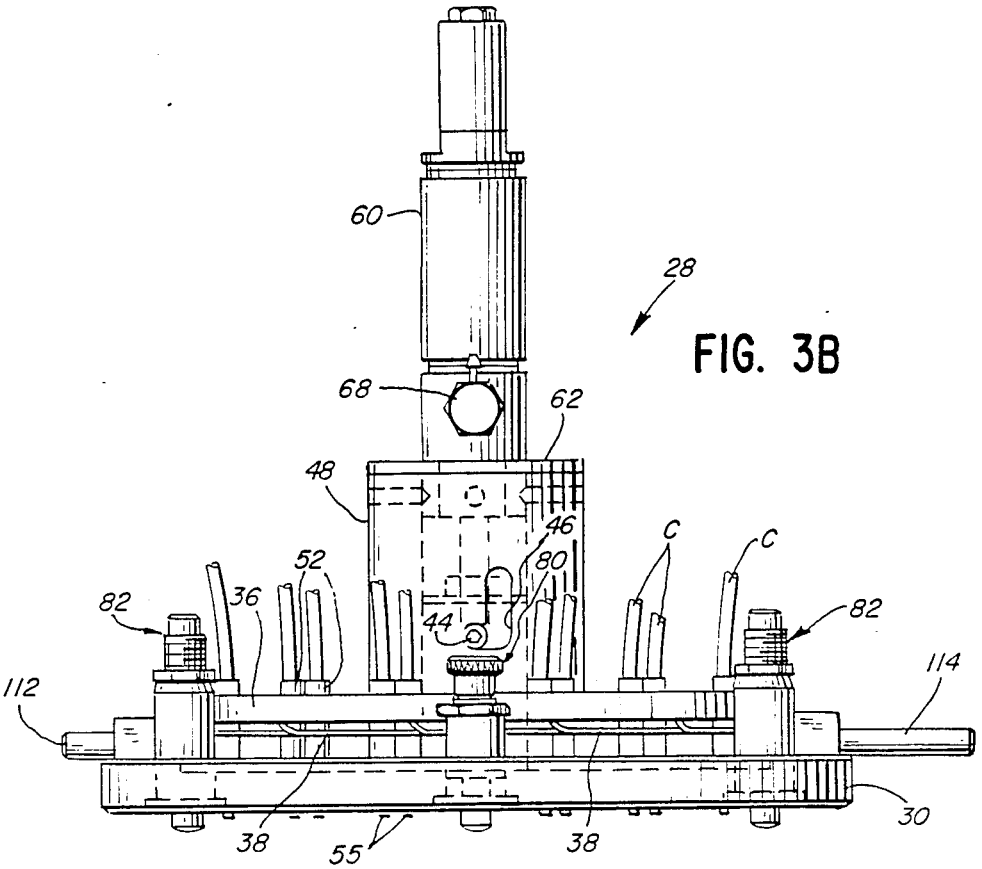
FIG. 3*b* is a vertical elevation corresponding to FIG. 3*a* and showing the lock plate member in its upper release position.
Figure 4:
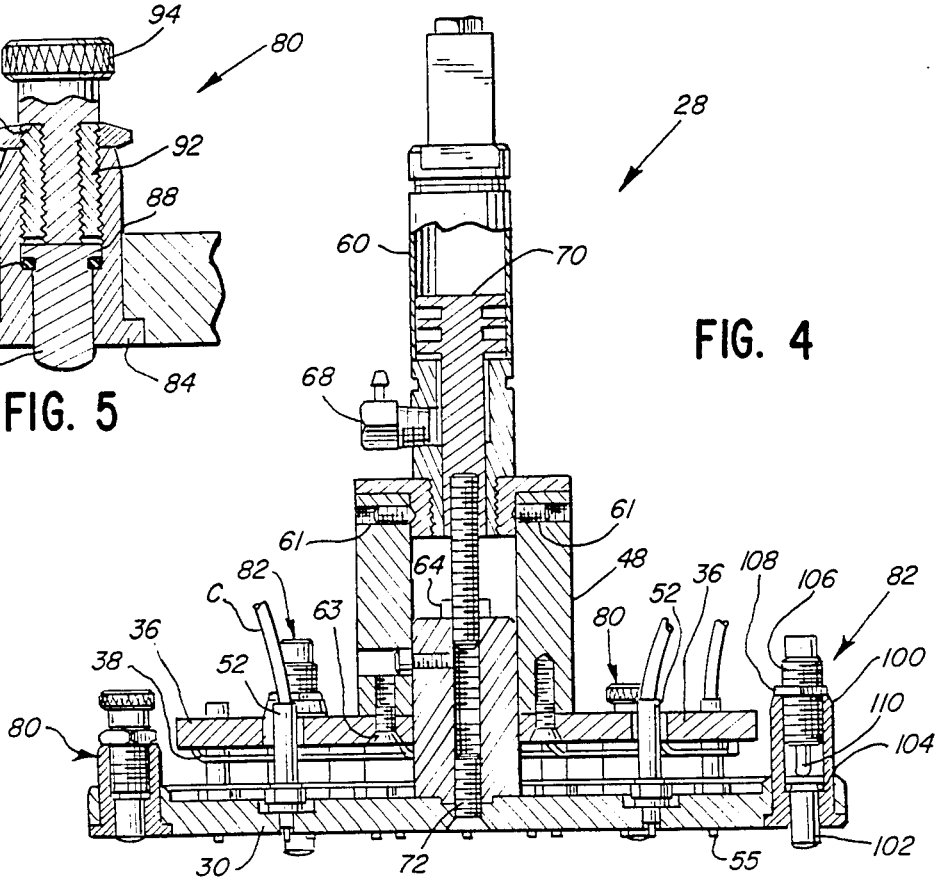
FIG. 4 is a vertical section taken along the line 4—4 of FIG. 3.
Figure 12:
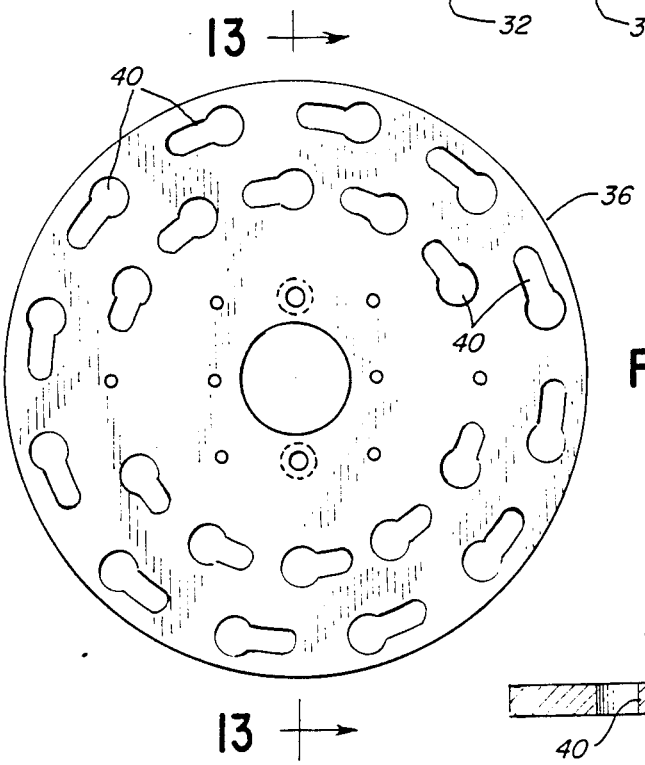
FIG. 12 is a detail top plan view of a lock plate.
Figure 13:
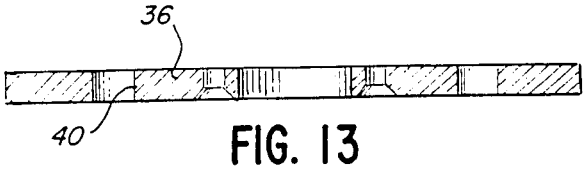
FIG. 13 is a side elevational view of the lock plate of FIG. 12.

FIGS. 3*a*, 3*b* and 4 show the connector holder plate 30 in combination with an aluminum lock plate 36 and a spring plate 38. Before describing the connector plate assembly 28 more fully, reference is made to FIGS. 12 and 13 which show the lock plate 36. The lock plate 36 is formed with 22 keyhole shaped openings 40 which cooperate with the openings 34 in the connector holder 30 to position and hold a plurality of fiber optic connectors during a polishing operation.

Figure 14:
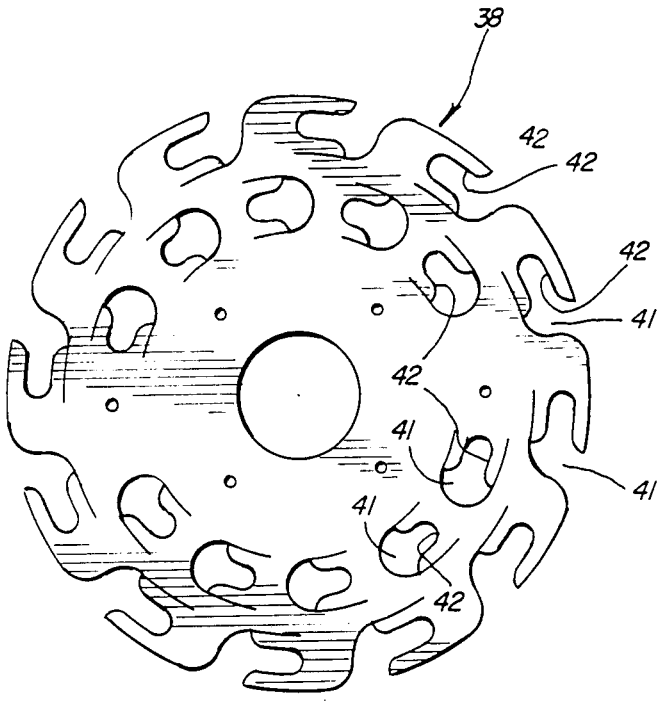
FIG. 14 is a detail top plan view of a spring lock plate.

As shown in FIGS. 3*b* and 4, a spring plate 38 is positioned between the connector holder plate 30 and the lock plate 36. FIG. 14 shows the spring plate 38 which is a thin sheet metal plate or the like provided with 22 slotted openings 41, 42 to cooperate with the openings 34 in the connector holder 30 and the keyhole shaped openings 40 in the lock plate 36 to position and hold a plurality of fiber optic connectors during a polishing operation. It will be seen in FIG. 14 that entrance portions 41 in the spring plate 38 lead into openings 42 so that a fiber optic connector initially located in the entrance portion 41 may subsequently be located in the narrower opening 42 by a slight clockwise rotation of spring plate 38.

As shown in FIGS. 3*a*, 3*b* and 4, the connector holder plate 30 is the lower plate of the assembly 28 and is fixed, while lock plate 36 is the spring plate 38 rotate cojointly a limited amount between a counterclockwise release portion of the lock plate 36 in FIG. 3*a* and a clockwise locked position shown in FIG. 6*a*. Thus, each fiber optic connector 50 is inserted into position as shown in FIG. 3*a* by inserting the connector down through an opening 40 in lock plate 36, through an entrance portion 41 in spring plate 38, and into a countersunk hole 34 in the connector holder 30.

When the fiber optic connectors 50 are initially loaded into the connector holder assembly 28, the lock plate 36 and spring plate 38 are in their counterclockwise positions as shown in FIG. 3*a*. In the foregoing position, the fiber optic connectors 50 are inserted down through the wider portions of the keyhole openings 40 in the lock plate 36 and through the wider entrance portions 41 in the spring plate 38. It should further be noted that when the lock plate 36 and spring plate 38 are in their counterclockwise positions, they are also in a raised position relative to the connector holder 30 as shown in FIGS. 3*b* and 4.

FIG. 3*b* shows a fixed pin 44 associated with an L-shaped slot 46 in a cylindrical member 48 which is fixed to the top of the lock plate 36. As shown in FIG. 3*b*, pin 44 is in the lower horizointal portion of L-shaped slot 46 when lock plate 36 is in the counterclockwise release position of FIG. 3*a*. However, when lock plate 36 and spring plate 38 are rotated to the clockwise position of FIG. 6*a*, it can be seen in FIG. 6*b* that the vertical portion of the L-shaped slot 46 is aligned with fixed pin 44 thereby permitting lock plate 36, spring plate 38, and cylinder 48 to fall downwardly to the position of FIGS. 6*b* and 7.

FIG. 8 shows the position of the fiber optic connector 50 when lock plate 36 has been rotated to its clockwise position of FIG. 6*a* and has fallen down to the position of FIG. 6*b*. In the latter position, the narrow portions of the keyhole openings 40 in lock plate 36 are aligned with the fiber optic connector 50. In addition, the narrower openings 42 in spring plate 38 are each aligned with a corresponding fiber optic connector. Furthermore, when lock plate 36 and spring plate 38 fall down to the position of FIGS. 6*b* and 7, spring plate 38 clamps down on a nut 54 portion of the fiber optic connector 50.

Still referring to FIG. 8, there is shown a fiber optic cable C having a fiber optic connector 50 attached at one end of the cable. The fiber optic connector 50 includes an upper sleeve portion 52, the nut member 54 including a shoulder 56 which is seated against the base of a countersunk opening 34 in the connector holder 30, and reduced lower sleeve members 53 and 55. The connector sleeve 55 projects beneath the bottom of the connector holder plate 30 as shown in FIG. 8. A tiny fiber optic member projects a slight amount from the lower end of the connector sleeve 55, and it is that projecting fiber optic end that is polished during a polishing operation.

It is known to provide a small bead of epoxy on the projecting point of the fiber optic end to assist in stablizing and supporting the fiber optic end during a polishing operation. Because the fiber optic end which projects down from the connector sleeve 55 is so tiny, it is not practical to illustrate it in the drawings. It will, however, be seen from FIG. 8 that the connector sleeve portion 53 projects into a narrower portion 34' of opening 34 to position connector 50 as shown in FIG. 8.

As best shown in FIG. 8, in the locked position of the lock plate 36 and spring plate 38, the fiber optic connector nut 54 is urged downwardly against the base of the countersunk hole 34 by the spring plate 38. The tops of the plurality of nuts 54 will not necessarily be in the precise same position, and the spring plate 38 serves the purpose of clamping down on all of the nut members regardless of their exact positions. In the locked position of the lock plate 36 and spring plate 38, each fiber optic connector 50 is held against vertical and lateral movement for a polishing operation.

A clamping operation is carried out before polishing of the fiber optic ends is commenced. For purposes of describing this feature, reference is made to FIG. 7 which shows lock plate 36 and spring plate 38 rotated to their clockwise locked positions in which they have dropped vertically due to alignment of fixed pin 44 with the vertical portion of L-shaped slot 46 (see FIG. 6*b*). The apparatus which effects clamping includes an air cylinder 60 which is threadably connected to a lock plate collar cap 62, the latter being fixedly attached by fasteners 61 to the cylindrical lock plate collar 48. The cylinder lock plate collar 48 is fixedly secured to the lock plate 36 by a plurality of screws 63. The lock spring plate 38 is affixed to the underside of the lock plate 36.

A piston rod 64 of air cylinder 60 is fixed to a lock plate stand off 66 which is attached to the connector holder plate 30. In order to effect clamping, air is supplied to fitting 68 which forces a piston 70 upwardly thereby raising piston rod 64 and lock plate stand off 66. The lock plate stand off 66 is connected by a threaded rod 72 to the connector holder plate 30. When air is supplied to fitting 68, connector holder plate 30 is drawn upwardly relative to lock plate 36 and spring plate 38 with the result that lock plate 36 is driven down to connector holder plate 30 causing spring plate 38 to clamp down on the upper surfaces of the plurality of fiber optic connector nuts 54 as illustrated in the locked position of FIG. 8. In the foregoing manner, each of the plurality of fiber optic connectors 50 is firmly held against movement either vertically or laterally during a polishing operation.

The connector holder plate 30 is provided on its bottom with three equally spaced adjustable stop members 80 as shown in FIG. 3*a*. In addition, the underside of the connector holder plate is provided with three equally spaced shock absorber members 82, the location of which is also shown in FIG. 3*a*. The purpose of the adjustable stop members 80 is to control the amount of material removed from the ends of the fiber optics during a rough polishing operation and during a final polishing operation. The purpose of the shock absorber members 82 is to control the movement of the connector holder plate 30 toward the surface of the rotating platen 12 (see FIG. 1*a*) during a polishing operation. The adjustable stop members 80 and the shock absorber members 82 will now be more fully described.

Figure 5:
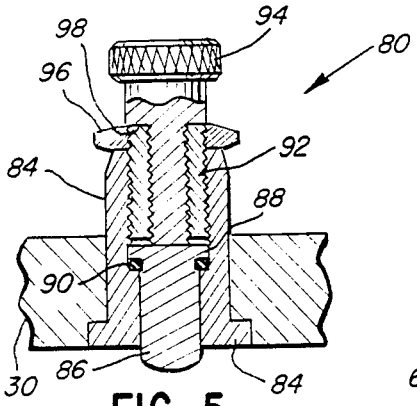
FIG. 5 is a fragmentary vertical section, taken along the line 5—5 of FIG. 3, showing an adjustable stop member.

FIG. 5 shows one of the adjustable stop members 80 including a mounting member 84 which is fixedly mounted in an opening in the connector holder plate 30. A diamond tipped shank member 86 is positioned within mounting member 84 so as to project downwardly beneath the bottom of the connector holder plate 30. The projecting lower end of the shank member 86 engages the surface of the rotatable plate 12 (see FIG. 1*a*) to prevent further material from being removed from the ends of the fiber optics. The shank 86 has an annular rim 88 at its upper end, and an O-ring 90 is positioned beneath the rim 88.

The diamond tipped shank 86 is capable of vertical movement within the mount 84 to permit adjustment of the amount by which the tip of the shank projects downwardly. In this manner, the stop member 80 is adjustable. A final adjustment screw is shown at 92, a coarse adjustment screw at 94, and a locknut at 96. The final adjusting screw 92 is threaded down into the mount 84 to a predetermined depth and locked into position by the locknut 96. During the final polishing operation, the upper end of the diamond tipped shank 86 will abut against the bottom of the final adjustment screw 92. In this manner, the position of the screw 92 controls the amount by which the diamond tipped shank 86 projects downwardly during the final polishing operation thereby controlling the amount of material removed from the plurality of fiber optic ends.

The coarse adjustment screw 94 is threaded down through an opening in the final adjustment screw 92 to a desired depth. In the operative position shown in FIG. 5, the coarse adjustment screw 94 is threaded downwardly as far as it can go, the limiting position being reached when an annular shoulder 98 engages against the top of the final adjustment screw 92. FIG. 5 illustrates the coarse adjustment screw 94 in its lowermost position which is its operative position, and it will be seen that in its lowermost position the lower end of the coarse adjustment screw 94 projects downwardly a slight predetermined amount beneath the lower end of the final adjustment screw 92. In the latter position, the lower end of the coarse adjustment screw 94 engages the upper end of the shank 86 and controls the amount by which the diamond tipped shank 86 projects beneath the bottom of the connector holder plate 30.

When a coarse polishing operation is conducted, the coarse adjustment screw 94 is threaded down to its lowermost operative position as shown in FIG. 5, and the amount by which the diamond tipped shank 86 projects beneath the connector holder plate 30 determines the amount of material removed from the ends of the fiber optic members. Thereafter, the coarse adjustment screw 94 is backed off or threaded upwardly to an inoperative position where the bottom of the screw 94 is above the lower end of the final adjustement screw 92. In the later case, the diamond tipped shank 86 is permitted to move upwardly a slight amount until its upper end engages against the bottom of the final adjustment screw 92 so the position of the latter controls the position of the shank 86 and thereby controls the amount of material removed from the fiber optic ends.

It will thus be understood that it is the position of the final adjustment screw 92 which controls the final length of the fiber optic ends. Also, the operative position of the coarse adjustment screw 94 determines the amount of material which will be removed during the preliminary or coarse polishing operation. The amount by which the bottom of the coarse adjustment screw 94 projects beneath the bottom of the final adjustment screw 92 in the position of FIG. 5 determines the additional amount of material which is removed during the final or second polishing operation.

In accordance with the embodiment being described, the added amount of material removed from the fiber optic ends during the final polishing operation is 0.002 inch. As is known in the art, it is customary to use a different abrasive medium in the coarse and the final polishing operations. This can readily be achieved by changing the abrasive paper applied to the top of the rotatable platen 12 (see FIG. 1*a*), or by utilizing a different polishing paste or the like on the platen.

Figure 7:
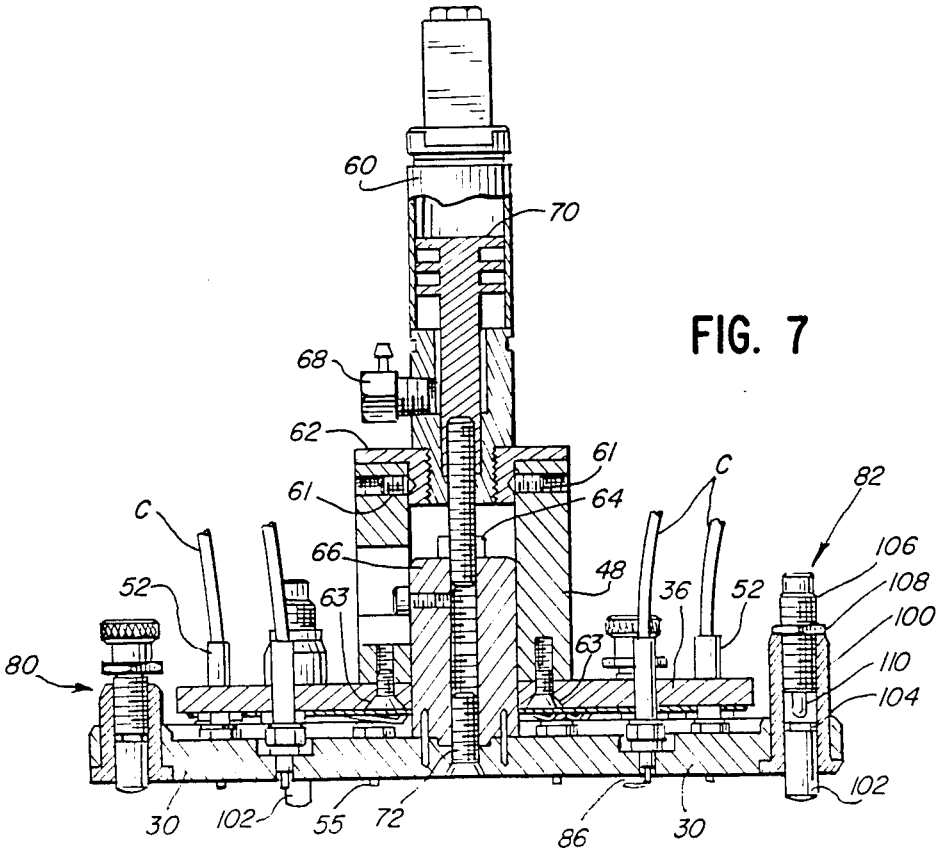
FIG. 7 is a vertical section taken along the line 7—7 of FIG. 6.

Reference is now made to FIGS. 4 and 7 which show one of the shock absorber members 82. The shock absorber 82 comprises a mounting member 100 which is fixedly mounted in an opening in the connector holder plate 30. A diamond-tipped shank member 102 is vertically slidable in mounting member 100, and the shank 102 has an annular groove for carrying an O-ring 104. A shock absorber 106 is threaded into the mounting member 100 until a nut 108 on the shock absorber engages the top of the mounting member. In the foregoing manner, the shock absorber 82 is fixedly mounted relative to the connector holder plate 30.

The upper end of the shank 102 engages against a projecting plunger 110 of the shock absorber 82 which thus controls upward movement of the diamond tipped shank 102. The shock absorber 82 is positioned relative to the connector holder plate 30 so that the three diamond tipped shanks 102 are the first elements to engage the abrasive platen 12, as will be explained more fully later herein. The shock absorber element 106, 110 per se is a conventional device available from various manufacturers.

Figure 2:
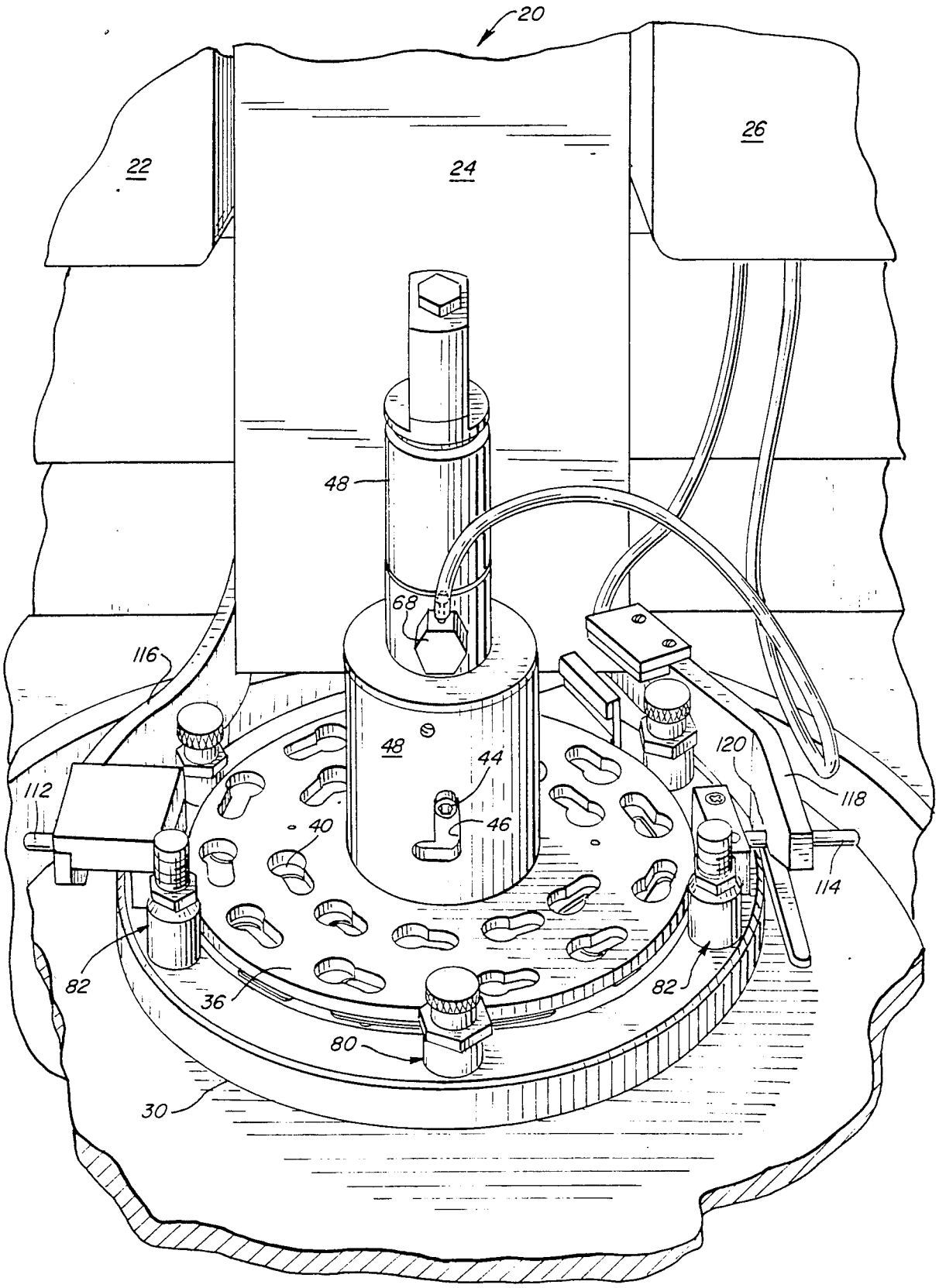
FIG. 2 is an enlarged fragmentary perspective view showing a connector holder assembly supported from arm support members in a manner which permits the connector holder assembly to float during an initial stage of a polishing operation.

Referring now to FIGS. 2 and 3*a*, FIG. 3*a* shows a pair of coaxial horizontal rods 112 and 114 which project outwardly from opposite sides of the connector holder plate 30. FIG. 2 shows a pair of generally horizontal support arms 116 and 118 which project forwardly from the center head member 24 (see FIG. 1a) and receive the rods 112 and 114 for supporting the connector holder assembly 28 from center head member 24. Each of the arms 116 and 118 has an entrance portion leading to a vertical slot 120 (see FIG. 9) in which the rods 112 and 114 are received. The purpose of the foregoing structure is to permit the connector holder assembly 28 to float relative to the center head member 24 for a period of time after the three diamond tipped shank members 102 controlled by shock absorbers 82 initially engage the rotating abrasive platen 12 (see FIG. 1a).

A polishing operation will now be described. With lock plate 36 and lock spring 38 in their counterclockwise or release positions as shown in FIGS. 3*a*, 3*b* and 4, a plurality of fiber optic connectors 50 (see FIG. 8) are inserted down through the openings 40 in the lock late 36 until the connectors seat in the countersunk holes 34 in the connector holder plate 30 as shown in FIG. 8. The lock plate 36 to which spring plate 38 is attached is then manually rotated to its clockwise locked position shown in FIGS. 6*a*, 6*b*, 7 and 8 in which the fiber optic connectors 50 are positioned in the narrow portions of the keyhole shaped openings 40 of the lock plate 36 and in the narrow slot portions 42 of the spring plate 38.

Also, in the latter position of the lock plate 36, fixed pin 44 (see FIG. 6*b*) is aligned with the vertical portion of slot 46 so lock plate 36 falls to its lower position shown in FIGS. 6*b* and 7 and is prevented from rotation in a counterclockwise direction. At this time, air is admitted to fitting 68 (see FIG. 7) causing lock plate 36 and spring plate 38 to be clamped down relative to connector holder plate 30 thereby clamping each of the fiber optic connectors 50 in position as shown in FIG. 8.

After the fiber optic connectors 50 are clamped in position, the operator actuates the polishing machine shown in FIGS. 1*a* and 1*b* to initiate rotation of the platen 12 and cause operation of head 20. The entire head assembly 20 including head members 22, 24 and 26 begins to oscillate horizontally back and forth, while head 20 also descends due to drive means within the head (not shown) which causes an initial rapid downward movement of head 20 followed by a slower downward movement as connector holder plate 30 closely approaches the rotating platen 12.

Figure 9A:
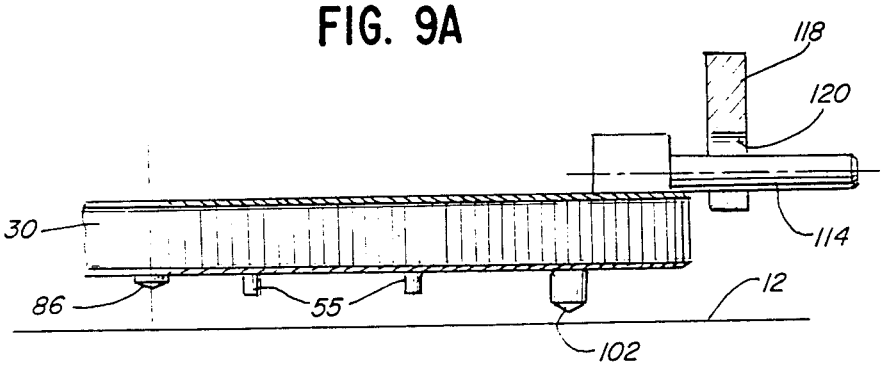
FIGS. 9*a*, 9*b*, 9*c* and 9*d* are schematic views illustrating different positions of the connector assembly during a polishing operation.

FIG. 9*a* shows connector holder 30 as it approaches abrasive platen 12, and it can be seen that the diamond-tipped shanks 102 of the shock absorbers 82 are the first elements to engage the platen. As such engagement occurs, the rods 112 and 114 (see FIGS. 2 and 3*a*) are still at the bottom of the vertical slots 120 in support arms 116 and 118, and therefore head 20 which is being driven downwardly by drive means (not shown) does not apply force to the connector holder 30. Instead, the connector holder assembly 28 moves downwardly by force of gravity so as to gradually compress the shock absorbers 80 which stabilize the connector holder 30 and control its downward movement.

Figure 9B:
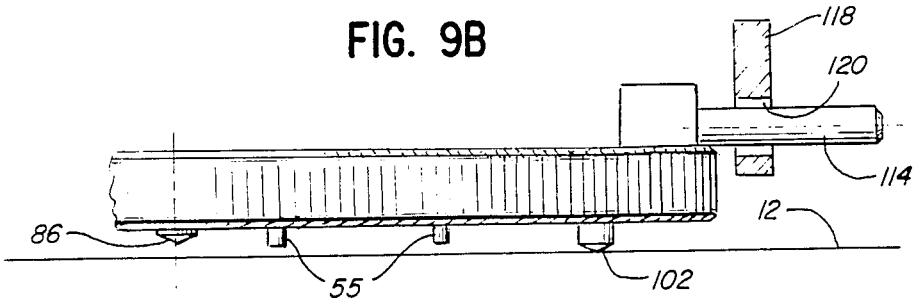
Figure 9C:
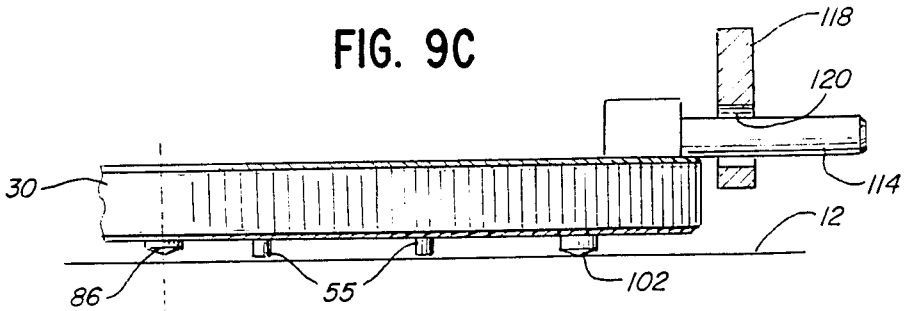
Figure 9D:
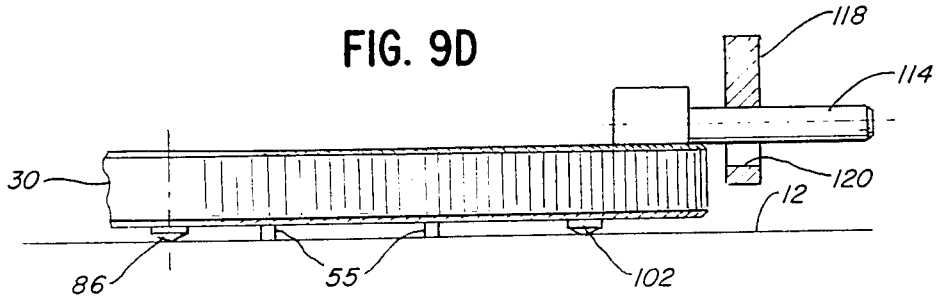

During the above movement, connector sleeves 55 move down as shown in FIG. 9*b* until the projecting fiber optic ends engage the rotating platen 12 as shown in FIG. 9*c*, at which time polishing of the fiber optic ends is initiated. It can be seen from FIG. 9*c* that during such polishing of the fiber optic ends, it is only the force of gravity which is causing connector holder 30 to move downwardly and compress shock absorbers 82. The foregoing is evident from FIG. 9*c* because a positive downward force will be applied to the connector holder plate 30 by the downwardly moving head 20 only after rods 112 and 114 have reached the upper ends of the slots 120 in support arms 116 and 118 as illustrated in FIG. 9*d*. Prior to that time, the connector holder 30 is in effect floating relative to head 20 and the polishing force is applied by gravity.

When the position shown in FIG. 9*d* is reached, the rods 112 and 114 have reached the upper ends of the vertical slots 120 in support arms 116 and 118, and after that the downwardly moving head 20 applies a positive force to drive the connector holder 30 down to the point where the diamond-tipped stop members 86 firmly engage the rotating platen 12. Thereafter, no further polishing of the fiber optic ends occurs, since stops 86 control the amount of material removed from the fiber optic ends. As previously noted, after a rough polishing operating has been carried out as described above, coarse adjustment screw 94 (see FIG. 5) is backed off, and the abrasive surface of platen 12 may be changed. Thereafter, a final polishing operation may be carried out to remove an additional predetermined amount of material from the fiber optic ends.

During polishing it is preferred that head assembly 20 continue to oscillate horizontally back and forth from left to right as viewed in FIG. 1*a* as connector holder plate 30 gradually descends relative to rotating platen 12. It will further be noted that when the fiber optic connectors 50 are clamped in position as shown in FIG. 8, it is the seating of the connectors 50 in the countersunk openings 34 of the connector holder plate 30 that determines the position of the connectors. The spring plate 38 which is above the connectors has elements which bend as the spring plate is clamped downwardly thereby exerting a downward force on the connector nuts 54 regardless of the precise position of the latter.

In the preferred embodiment of the invention, shock absorbers 82 do not actually bottom out during a polishing operation. Before the operation is complete, the horizontal rods 112 and 114 will normally reach the upper ends of the vertical slots 120 as shown in FIG. 9*d*, because only if that happens will the head 20 apply a positive downward force to the connector holder 30 to assist gravity in assuring that the connector holder is fully driven down to the diamond stops 86. It is preferred that shock absorbers 82 do not bottom out so they can function to control downward movement of the connector holder plate 30 throughout the polishing operation. They must, of course, retract an amount sufficient to permit the desired amount of material to be removed from the fiber optic ends.

I claim:

1. Apparatus for simultaneously polishing multiple fiber optic ends which project from the ends of corresponding fiber optic cables, said cables each having a fiber optic connector attached adjacent an end thereof, said apparatus comprising, in combination, connector holder plate means having a plurality of seat means, one for seating each of a plurality of fiber optic connectors, said seat means including openings which permit each fiber optic end to project through said connector holder plate means for engagement with polishing means, and lock plate means mounted coaxially to said connector holder plate means and rotatable relative thereof, said lock plate means having a plurality of generally keyhole-shaped openings, one opening corresponding to each of said seat means, said lock plate means being rotatable between a loading position where larger portions of said keyhole-shaped openings are aligned with said seat means to permit insertion of a fiber optic connector through each of said keyhole-shaped openings into a corresponding one of said seat means and a locked position where smaller portions of said keyhole-shaped openings are aligned with said set means to lock said fiber optic connectors in said seat means.

2. Apparatus as defined in claim 1 including clamp means for clamping said lock plate means and said connector holder plate means together after a plurality of said fiber optic connectors have been passed through said corresponding keyhole-shaped openings and seated in said seat means and said lock plate means has been rotated to said locked position.

3. Apparatus as defined in claim 2 where said clamp means includes air cylinder means mounted to said lock plate means and including piston rod means connected to said connector holder plate means.

4. Apparatus as defined in claim 1 including spring plate means interposed between said lock plate means and said connector holder plate means, said spring plate means having a plurality of openings corresponding to said seat means and said keyhole-shaped openings, said spring plate means being connected to said lock plate means for rotation therewith and having flexible portions for biasing said fiber optic connectors in said seat means.

5. Apparatus as defined in claim 1 where said lock plate means is axially movable relative to said connector holder plate means, said lock plate means being movable axially toward said connector holder plate means when said lock plate means is rotated to said locked position, and means for preventing rotation of said lock plate means to said loading position when it has been moved axially toward said connector holder plate means.

6. Apparatus for simultaneously polishing multiple fiber optic ends which project from the ends of corresponding fiber optic cables, said cables each having a fiber optic connector attached adjacent an end thereof, said apparatus comprising, in combination, connector holder plate means having a plurlity of seat means, one for seating each of a plurality of fiber optic connectors, said seat means including openings which permit each fiber optic end to project through said connector holder plate means for engagement with polishing means, lock plate means mounted coaxially to said connector holder plate means and rotatable relative thereto, said lock plate means having a plurality of generally keyhole-shaped openings, one opening corresponding to each of said seat means, said lock plate means being rotatable between a loading position where larger portions of said keyhole-shaped openings are aligned with said seat means to permit insertion of a fiber optic connector through each of said keyhole-shaped openings into a corresponding one of said seat means and a locked position where smaller portions of said keyhole-shaped openings are aligned with said seat means to lock said fiber optic connectors in said seat means, and spring plate means interposed between said lock plate means and said connector holder plate means, said spring plate means having a plurality of openings corresponding to said seat means and said keyhole-shaped openings, said spring plate means being connected to said lock plate means for rotation therewith and having flexible portions for biasing said fiber optic connectors in said seat means, and clamp means for clamping said lock plate means, spring plate means and connector holder plate means together after a plurality of said fiber optic connectors have been passed through said corresponding keyhole-shaped openings and seated in said seat means and said lock plate means has been rotated to said locked position.

7. Apparatus as defined in claim 6 where said clamp means includes air cylinder means mounted to said lock plate means and including piston rod means connected to said connector holder plate means.

8. Apparatus as defined in claim 7 where said lock plate means is axially movable relative to said connector holder plate means, said lock plate means being movable axially toward said connector holder plate means when said lock plate means is rotated to said locked position, and means for preventing rotation of said lock plate means to said loading position when it has been moved axially toward said connector holder plate means.

9. Apparatus for simultaneously polishing multiple fiber optic ends which project from the ends of corresponding fiber optic cables, said cables each having a fiber optic connector attached adjacent an end thereof, said apparatus comprising, in combination, connector plate means having a plurality of seat means, one for seating each of a plurality of fiber optic connectors, said seat means including openings which permit each fiber optic end to project through a surface of said connector holder plate means for engagement with polishing means, lock means for locking each of said fiber optic connectors in corresponding seat means during a polishing operation, a plurality of shock absorber means which gradually collapse under load mounted to project from said surface of said connector holder plate means, each shock absorber means comprising a projecting shank member biased toward said polishing means by an axially movable portion of said shock absorber means and drive means for advancing said connector holder plate means toward said polishing means to engage said fiber optic ends against said polishing means, said plurality of shock absorber means being positioned to engage said polishing means prior to said fiber optic ends whereby said shock absorber means controls the rate at which said fiber optic ends advance toward said polishing means.

10. Apparatus as defined in claim 9 where said connector holder plate means is positioned horizontally and said polishing means is positioned beneath said connector holder plate means, said drive means serving to advance said connector holder plate means downwardly toward said polishing means.

11. Apparatus for simultaneously polishing multiple fiber optic ends which project from the ends of corresponding fiber optic cables, said cables each having a fiber optic connector attached adjacent an end thereof, said apparatus comprising, in combination, connector holder plate means having a plurality of seat means, one for seating each of a plurality of fiber optic connectors, said seat means including openings which permit each fiber optic end to project downwardly through said connector holder plate means for engagement with polishing means positioned beneath said connector holder plate means, lock means for locking each of said fiber optic connectors in corresponding seat means during a polishing operation, at least three shock absorber means which gradually collapse under load mounted in spaced relation on the underside of said connector holder plate means, each shock absorber means comprising a projecting shank member biased toward said polishing means by an axially movable portion of said shock absorber means and drive means for advancing said connector holder plate means downwardly toward said polishing means to engage said fiber optic ends against said polishing means, said shock absorber means being positioned to engage said polishing means prior to said fiber optic ends whereby said shock absorber means control the rate at which said fiber optic ends advance toward said polishing means.

12. Apparatus for simultaneously polishing multiple fiber optic ends which project from the ends of corresponding fiber optic cables, said cables each having a fiber optic connector attached adjacent an end thereof, said apparatus comprising, in combination, generally horizontal connector holder plate means having a plurality of seat means, one for seating each of a plurality of fiber optic connectors, said seat means including openings which permit each fiber optic end to project downwardly through said connector holder plate means for engagement with polishing means positioned beneath said connector holder plate means, lock means for locking each of said fiber optic connectors in corresponding seat means during a polishing operation, a plurality of shock absorber means mounted in spaced relation on the underside of said connector holder plate means, drive means for advancing said connector holder plate means downwardly toward said polishing means to engage said fiber optic ends against said polishing means, said plurality of shock absorber means being positioned to engage said polishing means prior to said fiber optic ends whereby said shock absorber means controls the rate at which said fiber optic ends advance toward said polishing means, and float means interconnecting said drive means with said connector holder plate means, said float means, upon engagement of said shock absorber means with said polishing means, permitting said drive means to move downwardly a predetermined amount relative to said connector holder plate means before applying a downward force to said connector holder plate means whereby during such relative movement said connector holder plate means will advance said fiber optic ends into said polishing means by force of gravity to effect polishing at a rate controlled by said shock absorber means and after said predetermined amount of relative movement said drive means will apply a positive downward force to said connector holder plate means, and stop means mounted on said connector holder plate means to control the amount of material removed from said fiber optic ends.

13. Apparatus as defined in claim 12 where at least three shock absorber means are mounted on the underside of said connector holder plate means.

14. Apparatus as defined in claim 13 where said float means includes generally horizontal rod means mounted on said connector holder plate means for cooperation with vertical slot means associated with said drive means.

15. Apparatus for simultaneously polishing multiple fiber optic ends which project from the ends of corresponding fiber optic cables, said cables each having a fiber optic connector attached adjacent an end thereof, said apparatus comprising, in combination, connector holder plate means having a plurality of seat means, one for seating each of a plurality of fiber optic connectors, said seat means including openings which permit each fiber optic end to project through a surface of said connector holder plate means for engagement with polishing means, lock means for locking each of said fiber optic connectors in corresponding seat means during a polishing operation, and a plurality of stop means mounted to project from said surface of said connector holder plate means to control the amount of material removed from said fiber optic ends during a polishing operation, said stop means including shank means which projects beyond said surface of said connector holder plate means by a set amount for engagement with said polishing means after a desired amount of material has been removed from said fiber optic ends, final adjustment screw means engageable against the back of said shank means to control the amount said shank means projects beyond said surface, and coarse adjustment screw means movable between an operative position where it projects a predetermined amount beyond said final adjustment screw means to control the position of said shank means and an inoperative position where it is retracted relative to said final adjustment screw means.

16. Apparatus as defined in claim 15 where said coarse adjustment screw means is threaded through an axial opening in said final adjustment screw means.

17. Apparatus as defined in claim 15 where each stop means includes mounting means fixedly mounted on said connector holder plate means, said shank means being slidably mounted in said mounting means, said final adjustment screw means being threadably mounted in said mounting means behind said shank means, and said coarse adjustment screw means being threaded through an axial opening in said final adjustment screw means.

* * * * *